US009810018B1

(12) United States Patent
Jaggli

(10) Patent No.: US 9,810,018 B1
(45) Date of Patent: Nov. 7, 2017

(54) CORD SAFETY DEVICE FOR WINDOW COVERINGS

(71) Applicant: David Louis Jaggli, Huntington Beach, CA (US)

(72) Inventor: David Louis Jaggli, Huntington Beach, CA (US)

(73) Assignee: David Louis Jaggli, Huntington Beach, CA (US)

( * ) Notice: Subject to any disclaimer, the term of this patent is extended or adjusted under 35 U.S.C. 154(b) by 0 days.

(21) Appl. No.: 15/177,345

(22) Filed: Jun. 9, 2016

(51) Int. Cl.
*E06B 9/326* (2006.01)

(52) U.S. Cl.
CPC ..... *E06B 9/326* (2013.01)

(58) Field of Classification Search
CPC ..... E06B 9/326
USPC ..... 160/168.1 R, 173 R, 170; 267/74
See application file for complete search history.

(56) References Cited

U.S. PATENT DOCUMENTS 6,792,995 B2 * 9/2004 Judkins ..... E06B 9/326 160/173 R
8,931,539 B1 * 1/2015 Jaggli ..... E06B 9/322 160/168.1 R
9,366,079 B1 * 6/2016 Jaggli ..... E06B 9/326

* cited by examiner

*Primary Examiner* — Blair M Johnson

(57) ABSTRACT

An elastic cord device for use in combination with a window covering device of the type comprising a pulley, a plurality of lift cords, a head rail, the lift cords used to raise and lower a window covering material. The elastic cord device can have a spiral helical shape. The elastic cord device is exposed and accessible so that the elastic cord device can be pulled to raise and lower the window covering material.

A window covering device comprising an elastic cord device, a head rail, a pulley, window covering material and lift cords; the elastic cord device is used to operate the window covering.

19 Claims, 3 Drawing Sheets

CORD SAFETY DEVICE FOR WINDOW COVERINGS

CROSS-REFERENCE TO RELATED APPLICATIONS

The present application is a continuation in part application of U.S. application Ser. No. 14/554,059, filed 2014 Nov. 2, which is a continuation application of U.S. Pat. No. 8,931,539, filed 2013 Jul. 2. All of the foregoing applications are hereby incorporated herein by reference in their entirety.

BACKGROUND OF INVENTION

In order to raise or fold up a cord operated venetian blind, or any other type of cord operated window covering, the cords are pulled downwardly which will increase the length of the cords that are exposed. Exposed cords pose a hazard for infants and young children. Efforts have been made to reduce the strangulation hazard posed by the lift cords on window coverings such as venetian blinds. One solution has been to separate the lift cords and attach a tassel to the end of each lift cord to keep the ends of the lift cords from entangling. Other solutions have been break away lift cords. There is still a hazard with these types of solutions because the lift cords are still accessible. There are some window coverings such as venetian blinds and roman shades manufactured that are cordless for safety but these types of cordless blinds or window coverings are approximately four to eight times more expensive and almost always have to be special ordered. Out of necessity, to save money, I invented an affordable cord safety device for window coverings to protect my children from this hazard. My invention keeps the lift cords in the head rail area; therefore they are out of the reach of infants and young children. My invention also allows the lift cords to remain equalized for level operation of the window covering. When you buy a window covering such as a venetian blind you need to cut and adjust the length of the lift cords but with my invention the cord automatically adjusts therefore making installation easier. My invention will be attached or installed during manufacturing.

BRIEF DESCRIPTION OF DRAWINGS

The window covering device in this description refers to a window covering device comprising a pulley, a head rail, at least two lift cords, the lift cords used to raise and lower a window covering material.

DETAILED DESCRIPTION

Elastic cord device 2 is for use in combination with a window covering device comprising a head rail 5, a pulley 8*b*, and at least two lift cords 1 used to raise and lower a window covering material 7.

A portion of elastic cord device 2 and lift cords 1 go onto pulley 8*b* in opposite directions.

A portion of elastic cord device 2 is always accessible for an operator to raise and lower the window covering material 7.

When window covering material 7 is in the lowered position and the portion of elastic cord device 2 that exits head rail 5 is pulled it rotates pulley 8*b* increasing the volume of lift cords 1 on pulley 8*b* raising window covering material 7.

Elastic cord device 2 and lift cords 1 go onto opposite sides of pulley 8*b*.

Figure 1:
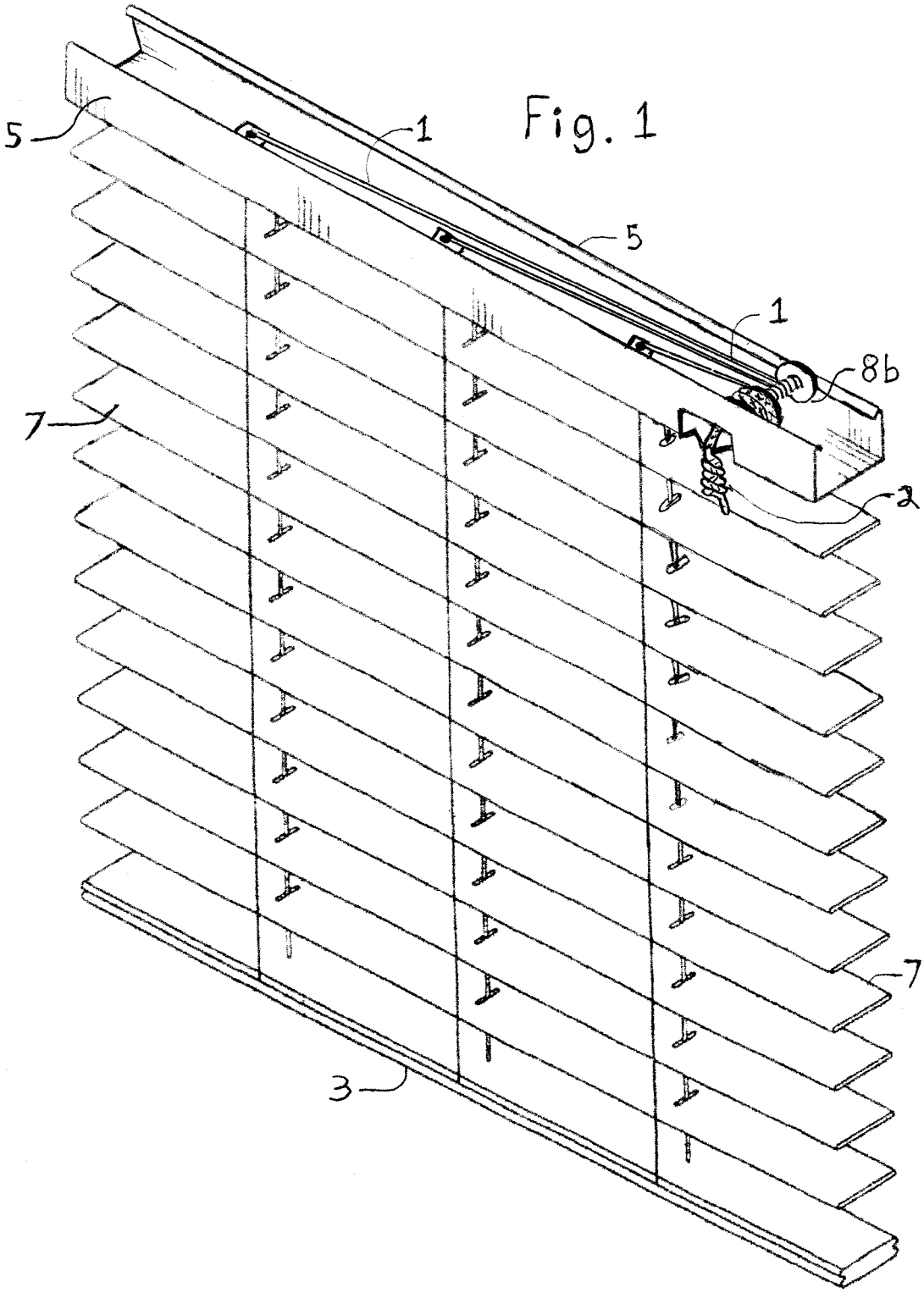
FIG. 1 is an angled overhead view of a window covering device in the lowered position.

FIG. 1 shows an angled overhead view of window covering material 7 in a lowered position, head rail 5, bottom rail 3, elastic cord device 2, lift cords 1, pulley 8*b*.

Figure 2:
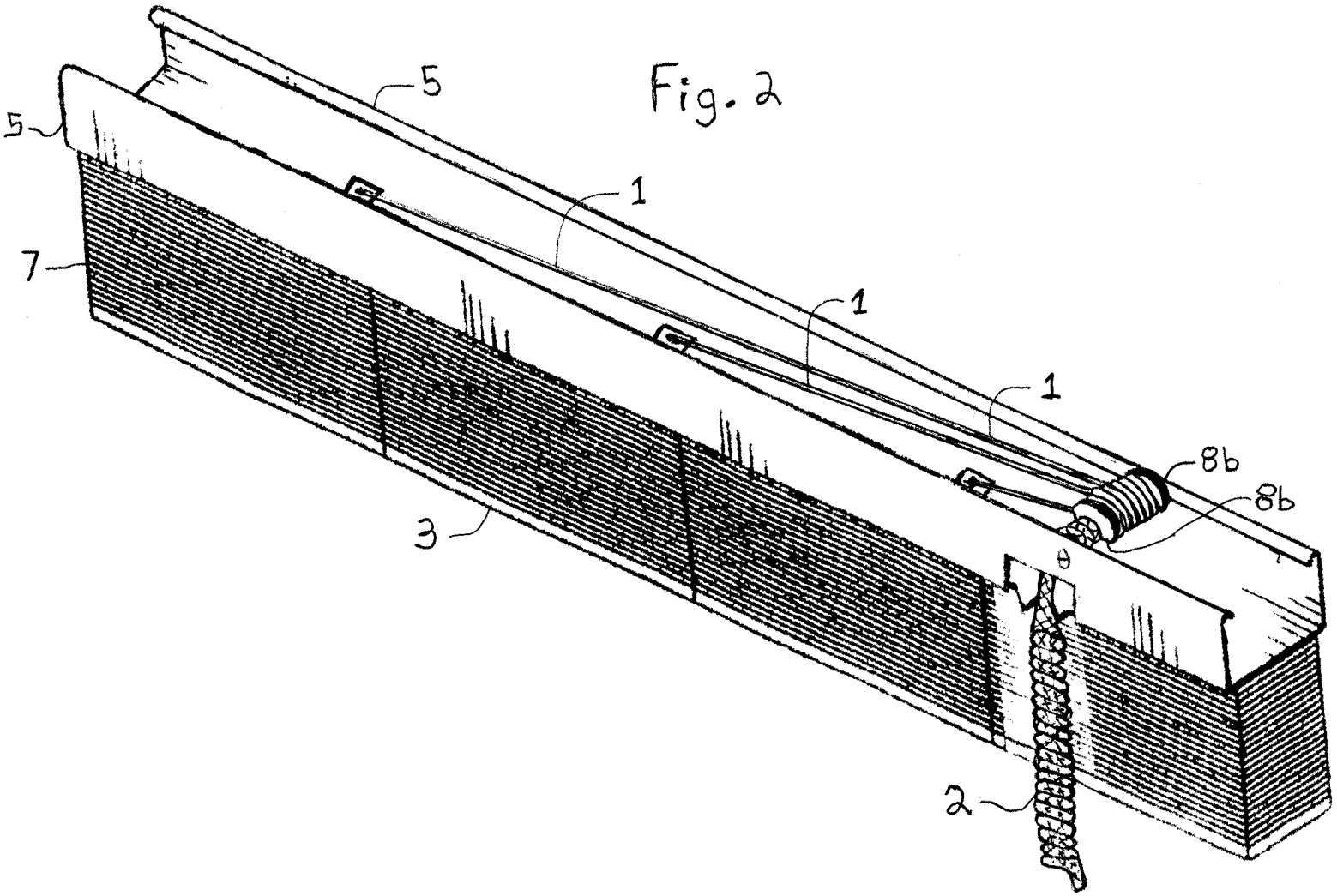
FIG. 2 is an angled overhead view of a window covering device in the raised position.

FIG. 2 shows an angled overhead view of window covering material 7 in a raised position, head rail 5, bottom rail 3, elastic cord device 2, lift cords 1, pulley 8*b*.

Figure 3:
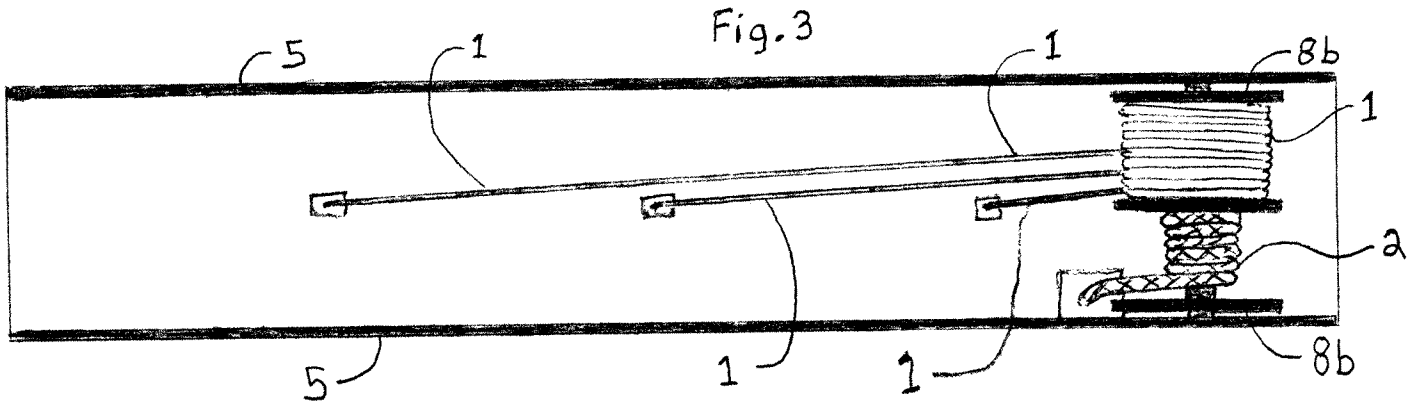
FIG. 3 is an overhead view of a head rail of a window covering device in the raised position.

FIG. 3 shows an overhead view of head rail 5 when the window covering material 7 is in a raised position, elastic cord device 2, lift cords 1, pulley 8*b*.

Figure 4:
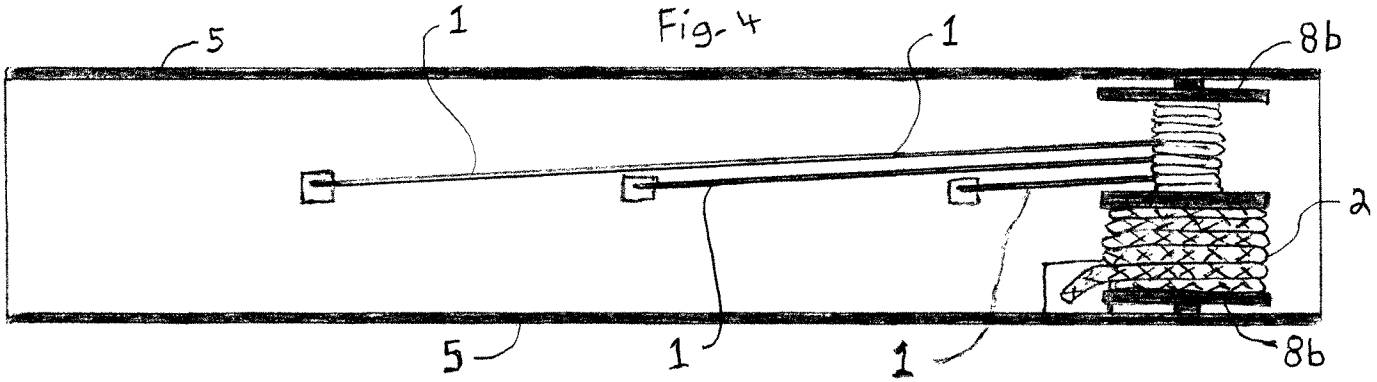
FIG. 4 is an overhead view of a head rail of a window covering device in the lowered position.

FIG. 4 shows an overhead view of head rail 5 when the window covering material 7 is in a lowered position, elastic cord device 2, lift cords 1, pulley 8*b*.

FIG. 1 shows window covering material 7 in the lowered position. When window covering material 7 is in the lowered position, elastic cord device 2 has elongated onto one side of pulley 8*b*. Elastic cord device 2 elongates when going onto pulley 8*b* allowing the window covering material 7 to be in the lowered position and a portion of lift cords 1 has come off of pulley 8*b*. A portion of elastic cord device 2 is outside head rail 5. This portion of elastic cord device 2 is what will be pulled in order to raise window covering material 7.

FIG. 2 shows window covering material 7 in the raised position. When window covering material 7 is in the raised position, a portion of lift cords 1 go onto one side of pulley 8*b* and a portion of elastic cord device 2 have come off pulley 8*b* and exits head rail 5. The portion of elastic cord device 2 that is outside head rail 5 springs back to its relaxed state and is out of the reach of infants and young children. The portion of elastic cord device 2 that is outside head rail 5 is what will be accessible in order to lower window covering material 7.

FIG. 3 shows an overhead view of head rail 5 when window covering material 7 is in the raised position. Instead of lift cords 1 exiting head rail 5 they are kept inside head rail 5. A portion of lift cords 1 have been directed onto one side of pulley 8*b*. A portion of elastic cord device 2 has come off pulley 8*b*.

FIG. 4 shows an overhead view of head rail 5 when the window covering material 7 is in the lowered position. A portion of elastic cord device 2 has elongated onto one side of pulley 8*b* and a portion of lift cords 1 have come off of pulley 8*b* lowering window covering material 7.

Pulley 8*b* can be different shapes and different dimensions to fit the different dimensions of head rails used in window coverings.

Pulley 8*b* can be mounted directly to head rail 5.

Pulley 8*b* can be mounted to head rail 5 at different angles.

Pulley 8*b* can be mounted to a housing first before being mounted to head rail 5.

Elastic cord device 2 can be different lengths, sizes, and shapes to fit and operate different types or sizes of window covering devices.

Elastic cord device 2 can be made with an elastic central flexible core.

Elastic cord device 2 can have an elasticized outer braided textile covering.

Elastic cord device 2 can be made of strands of rubber or a rubber synthetic combined with a textile material.

Elastic cord device 2 can be solid or hollow.

Elastic cord device 2 can be made of fiber reinforced composite plastics.

Elastic cord device 2 can be made of metal, plastic or a combination of both.

Elastic cord device 2 can be made of nylon and or polyester type cord materials combined with rubber or rubber synthetic.

Elastic cord device 2 can have a spiral helical shape.

Elastic cord device 2 can stretch or elongate as much as or more than approximately seven times its relaxed state.

A portion of elastic cord device 2 and a portion of lift cords 1 are capable of wrapping around pulley 8*b* at the same time in opposite directions.

Pulley 8*b* can be made of metal, plastic or a combination of both.

Pulley 8*b* can be snap fitted into head rails.

Elastic cord device 2 can be used in combination with a window covering device comprising a head rail and a pulley.

Elastic cord device 2 can be used in combination with a head rail assembly for a window covering device.

Elastic cord device 2 and pulley 8*b* can be used as an assembly for a window covering device.

Thus, the reader will see that the cord safety device for window coverings provides many advantages.

Many infants and young children die every year from corded window coverings. The cord safety device for window coverings retracts out of the reach of infants and young children, providing a safer environment.

There are still cord operated window coverings on the market and they are more affordable than the cordless window coverings. Parents, apartment owners and business owners will sometimes choose cost over safety. That is precisely why, out of necessity, I invented the cord safety device for window coverings and was able to keep the lift cords out of the reach of my children.

For many years there have been many attempts to remove corded window coverings from the market because of the lift cords hanging down and posing a strangulation hazard. The cord safety device for window coverings lets manufactures still produce cord operated window coverings without the danger of lift cords hanging down, providing a safer window covering. The cord safety device is an affordable and safe way to keep corded window coverings on the market.

The cord safety device for window coverings allows the lift cords to remain equalized for level operation of the window covering.

When a consumer purchases a window covering with the cord safety device attached to the window covering the consumer will not need to cut and adjust the length of the lift cords, making the installation of the window covering easier.

Manufactures can add this cord safety device for window coverings without having to alter the design or structure of their corded window coverings. This provides a cost effective means for providing safer window coverings.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

I claim:

1. An improved operating cord in combination with a window covering device comprising a headrail, a pulley supported by said headrail, and a movable window covering material, said operating cord comprising an elasticized operating cord operably coupled to said movable window covering material and said pulley, a portion of said elasticized operating cord is spaced from said headrail and accessible to an operator for stretching said elasticized operating cord to move said movable window covering material, the portion of said elasticized operating cord spaced from said headrail and accessible is capable of springing back towards said headrail and is in a relaxed state when not being stretched by an operator to move said movable window covering material whereby said exposed and accessible portion of said elasticized operating cord is retracted to a position relatively adjacent said headrail.

2. The combination of claim 1 wherein said elasticized operating cord is capable of stretching or elongating as much as or more than approximately seven times it's relaxed state.

3. The combination of claim 1 wherein said elasticized operating cord comprising textiles combined with an elastomeric material.

4. The combination of claim 1 wherein said elasticized operating cord comprising strands of elastomeric material combined with textile materials.

5. The combination of claim 1 wherein said elasticized operating cord is capable of a spiral helical shape in its relaxed state.

6. The combination of claim 1 wherein said elasticized operating cord comprising fiber reinforced composite plastics.

7. The combination of claim 1 wherein said elasticized operating cord is capable of going around said pulley.

8. A window covering device comprising;

A window covering material having a stationary end and a movable end;

The window covering material movable end capable of being selectively movable in a first direction toward an expanded position and a second direction toward a retracted position, whereby the stationary end and the movable end are spaced further apart in the expanded position than in the retracted position, thereby providing different covering characteristics;

An elasticized cord;

said elasticized cord having a first end operably coupled with said covering material and a second end;

said second end capable of, upon application of a pulling force, moving from a first position toward a second position such that the elastic cord is stretched, thereby causing said covering material to move in at least one of said first and second directions, said second end returning to a position relatively adjacent said first end upon at least a reduction of the pulling force.

9. The window covering device of claim 8 wherein said elasticized cord is capable of stretching or elongating as much as or more than approximately seven times its relaxed state.

10. The window covering device of claim 8 wherein said elasticized cord comprising textiles combined with an elastomeric material.

11. The window covering device of claim 8 wherein said elasticized cord comprising strands of elastomeric material combined with textile materials.

12. The window covering device of claim 8 wherein said elasticized cord is capable of a spiral helical shape in its relaxed state.

13. The window covering device of claim 8 wherein said elasticized cord comprising fiber reinforced composite plastics.

14. The window covering device of claim 8 further including a headrail for supporting said window covering material.

15. The window covering device of claim 8 further including a pulley.

16. The window covering device of claim 8 further including at least one cord used in combination with said elasticized cord to move said window covering material.

17. The window covering device of claim 8 comprising an elasticized outer braided textile covering.

18. The window covering device of claim 8 capable of wrapping around said pulley multiple times.

19. A window covering device comprising at least one cord connected to a moveable window covering material, a headrail, a pulley supported by the headrail and an elasticized cord device; a portion of said at least one cord and a portion of said elasticized cord device go onto and around said pulley, a portion of said elasticized cord device is exposed and accessible from said headrail to an operator to move said movable window covering material, whereby when said portion of said elasticized cord device that is exposed and accessible is pulled by the operator, it stretches and rotates said pulley, thereby winding said at least one cord on said pulley thereby moving said movable window covering material, the portion of said elasticized cord device that is exposed and accessible springs back to an unstretched, relaxed state when not being pulled by the operator.

* * * * *